US010186226B2

(12) United States Patent
Seo et al.

(10) Patent No.: US 10,186,226 B2
(45) Date of Patent: Jan. 22, 2019

(54) TRANSPARENT DISPLAY DEVICE AND METHOD OF COMPENSATING AN IMAGE FOR THE SAME

(71) Applicant: Samsung Display Co., Ltd., Yongin-Si, Gyeonggi-Do (KR)

(72) Inventors: Young-Jun Seo, Seoul (KR); Hyo-Sun Kim, Seongnam-si (KR); Byung-Choon Yang, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 45 days.

(21) Appl. No.: 15/147,200

(22) Filed: May 5, 2016

(65) Prior Publication Data

US 2017/0061889 A1 Mar. 2, 2017

(30) Foreign Application Priority Data

Aug. 25, 2015 (KR) ..... 10-2015-0119706

(51) Int. Cl.
*G09G 3/36* (2006.01)
*G09G 3/3275* (2016.01)

(52) U.S. Cl.
CPC ..... *G09G 3/3685* (2013.01); *G09G 3/3275* (2013.01); *G09G 2320/0673* (2013.01); *G09G 2360/144* (2013.01)

(58) Field of Classification Search
CPC ..... G09G 3/3685; G09G 3/3275
See application file for complete search history.

(56) References Cited

U.S. PATENT DOCUMENTS 6,593,934 B1 * 7/2003 Liaw ..... G09G 3/2092 345/590
6,836,565 B1 * 12/2004 Nishikawa ..... H04N 1/407 382/167
2009/0256935 A1 * 10/2009 Endo ..... H04N 5/202 348/254
2010/0039455 A1 * 2/2010 Ahn ..... G09G 3/3648 345/690
2010/0165002 A1 * 7/2010 Ahn ..... G09G 3/3648 345/690
2014/0022287 A1 * 1/2014 Ahn ..... G09G 3/3607 345/690
2015/0070406 A1 * 3/2015 Baek ..... G09G 3/3406 345/690
2015/0187094 A1 * 7/2015 Lee ..... G06T 5/009 345/590
2015/0356902 A1 12/2015 Seo et al.
2016/0027388 A1 1/2016 Seo et al.
2016/0140891 A1 * 5/2016 Lim ..... G09G 3/2007 345/690

* cited by examiner

*Primary Examiner* — Robert Stone
(74) *Attorney, Agent, or Firm* — Cantor Colburn LLP

(57) ABSTRACT

A transparent display device includes a transparent display panel which displays an image, a scan driver which provides a scan signal to the transparent display panel, a data driver which driver converts image data into a data signal based on an applied gamma curve and provides the data signal to the transparent display panel, a timing controller which controls the scan driver and the data driver, and a gamma curve adjuster which adjusts the applied gamma curve based on a reference gamma value of a reference gamma curve, luminance of incident light that enters the transparent display panel, light transmittance of the transparent display panel, and panel-luminance of the transparent display panel.

18 Claims, 8 Drawing Sheets

TRANSPARENT DISPLAY DEVICE AND METHOD OF COMPENSATING AN IMAGE FOR THE SAME

This application claims priority to Korean Patent Application No. 10-2015-0119706, filed on Aug. 25, 2015, and all the benefits accruing therefrom under 35 U.S.C. § 119, the content of which in its entirety is herein incorporated by reference.

BACKGROUND

1. Field

Exemplary embodiments relate generally to a display device. More particularly, exemplary embodiments of the invention relate to a transparent display device and a method of compensating an image for the transparent display device.

2. Description of the Related Art

Recently, an interest in a transparent display device (e.g., a car window, a show window, a building window, etc.) that allows a viewer to recognize an object located behind the transparent display device as well as visual information displayed by the transparent display device has been heightened. Generally, since external or incident light directly affects an image displayed by the transparent display device, problems due to the external or incident light such as image tone change, image preference degradation, and the like may occur. Thus, under a condition in which the external light is relatively strong, it may be difficult for a viewer to clearly recognize an image displayed by the transparent display device. To overcome such a problem, a conventional transparent display device sets a gamma curve corresponding to a tone curve (e.g., a 2.2 gamma curve) by considering a general environment, and then adjusts the gamma curve according to contents (e.g., a moving image, a still image, etc.) and/or adjusts panel-luminance according to surrounding brightness.

SUMMARY

A conventional transparent display device has limits in terms of effectiveness because the conventional transparent display device does not use (or, allow for) luminance of incident light that enters a transparent display panel included in the conventional transparent display device and light transmittance of the transparent display panel.

Exemplary embodiments provide a transparent display device that can adjust an applied gamma curve based on a reference gamma value of a reference gamma curve, luminance of incident light that enters a transparent display panel included in the transparent display device, light transmittance of the transparent display panel, and panel-luminance of the transparent display panel.

Exemplary embodiments provide a method of compensating an image for a transparent display device that can compensate an image displayed on a transparent display panel included in the transparent display device.

According to an exemplary embodiment of exemplary embodiments, a transparent display device may include a transparent display panel that displays an image, a scan driver that provides a scan signal to the transparent display panel, a data driver that converts image data into a data signal based on an applied gamma curve and provides the data signal to the transparent display panel, a timing controller that controls the scan driver and the data driver, and a gamma curve adjuster that adjusts the applied gamma curve based on a reference gamma value of a reference gamma curve, luminance of incident light that enters the transparent display panel, light transmittance of the transparent display panel, and panel-luminance of the transparent display panel.

In exemplary embodiments, the transparent display device may further include an incident light sensor that measures the luminance of the incident light and provides luminance information indicating the luminance of the incident light to the gamma curve adjuster.

In exemplary embodiments, the gamma curve adjuster may receive luminance information indicating the luminance of the incident light from a light sensing device located outside the transparent display device.

In exemplary embodiments, the gamma curve adjuster may receive light transmittance information indicating the light transmittance of the transparent display panel from the transparent display panel.

In exemplary embodiments, the gamma curve adjuster may receive panel-luminance information indicating the panel-luminance of the transparent display panel from the transparent display panel.

In exemplary embodiments, the gamma curve adjuster may include a gamma curve storing block that stores the reference gamma curve, a gamma value calculating block that calculates an applied gamma value based on the reference gamma value of the reference gamma curve, the luminance of the incident light, the light transmittance of the transparent display panel, and the panel-luminance of the transparent display panel, and a gamma curve generating block that generates the applied gamma curve having the applied gamma value.

In exemplary embodiments, the reference gamma value of the reference gamma curve may be 2.2.

In exemplary embodiments, the gamma value calculating block may generate a luminance ratio by dividing the luminance of the incident light by the panel-luminance of the transparent display panel and may generate a comparison target value by multiplying the light transmittance of the transparent display panel by the luminance ratio.

In exemplary embodiments, the gamma value calculating block may determine the reference gamma curve to be the applied gamma curve when the comparison target value is smaller than a gamma adjustment reference value.

In exemplary embodiments, when the comparison target value is smaller than the gamma adjustment reference value, the gamma value calculating block may calculate the applied gamma value based on [Equation 1] below:

$$AGV=RGV, \quad \text{[Equation 1]}$$

where AGV denotes the applied gamma value, and RGV denotes the reference gamma value.

In exemplary embodiments, the gamma value calculating block may logarithmically decrease the applied gamma value as the comparison target value increases when the comparison target value is greater than or equal to a gamma adjustment reference value.

In exemplary embodiments, when the comparison target value is greater than or equal to the gamma adjustment reference value, the gamma value calculating block may calculate the applied gamma value based on [Equation 2] below:

$$AGV=M\times(RGV-K)-N\times\ln(T\times SR), \quad \text{[Equation 2]}$$

where AGV denotes the applied gamma value, RGV denotes the reference gamma value, T denotes the light transmittance of the transparent display panel, SR denotes the luminance ratio, and M, N, and K are rational numbers other than 0.

In exemplary embodiments, the gamma curve adjuster may be implemented in the timing controller or in the data driver.

In exemplary embodiments, the gamma curve adjuster may be implemented separately from the timing controller and the data driver.

According to another exemplary embodiment of exemplary embodiments, a method of compensating an image for a transparent display device may include an operation of receiving a reference gamma value of a reference gamma curve, an operation of securing luminance of incident light that enters a transparent display panel included in the transparent display device, light transmittance of the transparent display panel, and panel-luminance of the transparent display panel, an operation of calculating an applied gamma value based on the reference gamma value of the reference gamma curve, the luminance of the incident light, the light transmittance of the transparent display panel, and the panel-luminance of the transparent display panel, an operation of generating an applied gamma curve having the applied gamma value, and an operation of converting image data into a data signal to be applied to the transparent display panel based on the applied gamma curve.

In exemplary embodiments, the operation of calculating the applied gamma value may include an operation of generating a luminance ratio by dividing the luminance of the incident light by the panel-luminance of the transparent display panel and an operation of generating a comparison target value by multiplying the light transmittance of the transparent display panel by the luminance ratio.

In exemplary embodiments, the reference gamma curve may be determined to be the applied gamma curve when the comparison target value is smaller than a gamma adjustment reference value.

In exemplary embodiments, when the comparison target value is smaller than the gamma adjustment reference value, the applied gamma value may be calculated based on [Equation 1] below:

$$AGV=RGV, \quad \text{[Equation 1]}$$

where AGV denotes the applied gamma value, and RGV denotes the reference gamma value.

In exemplary embodiments, the applied gamma value may be logarithmically decreased as the comparison target value increases when the comparison target value is greater than or equal to a gamma adjustment reference value.

In exemplary embodiments, when the comparison target value is greater than or equal to the gamma adjustment reference value, the applied gamma value may be calculated based on [Equation 2] below:

$$AGV=M\times(RGV-K)-N\times\ln(T\times SR), \quad \text{[Equation 2]}$$

where AGV denotes the applied gamma value, RGV denotes the reference gamma value, T denotes the light transmittance of the transparent display panel, SR denotes the luminance ratio, and M, N, and K are rational numbers other than 0.

Therefore, a transparent display device according to exemplary embodiments may effectively reduce image tone change, image preference degradation, and the like due to external light that occurs in an image displayed on a transparent display panel included in the transparent display device by adjusting an applied gamma curve based on a reference gamma value of a reference gamma curve, luminance of incident light that enters the transparent display panel, light transmittance of the transparent display panel, and panel-luminance of the transparent display panel.

In addition, a method of compensating an image for a transparent display device according to exemplary embodiments may control the transparent display device to display a high-quality image in various external light environments.

BRIEF DESCRIPTION OF THE DRAWINGS

Illustrative, non-limiting exemplary embodiments will be more clearly understood from the following detailed description taken in conjunction with the accompanying drawings, in which.

DETAILED DESCRIPTION

Figure 1:
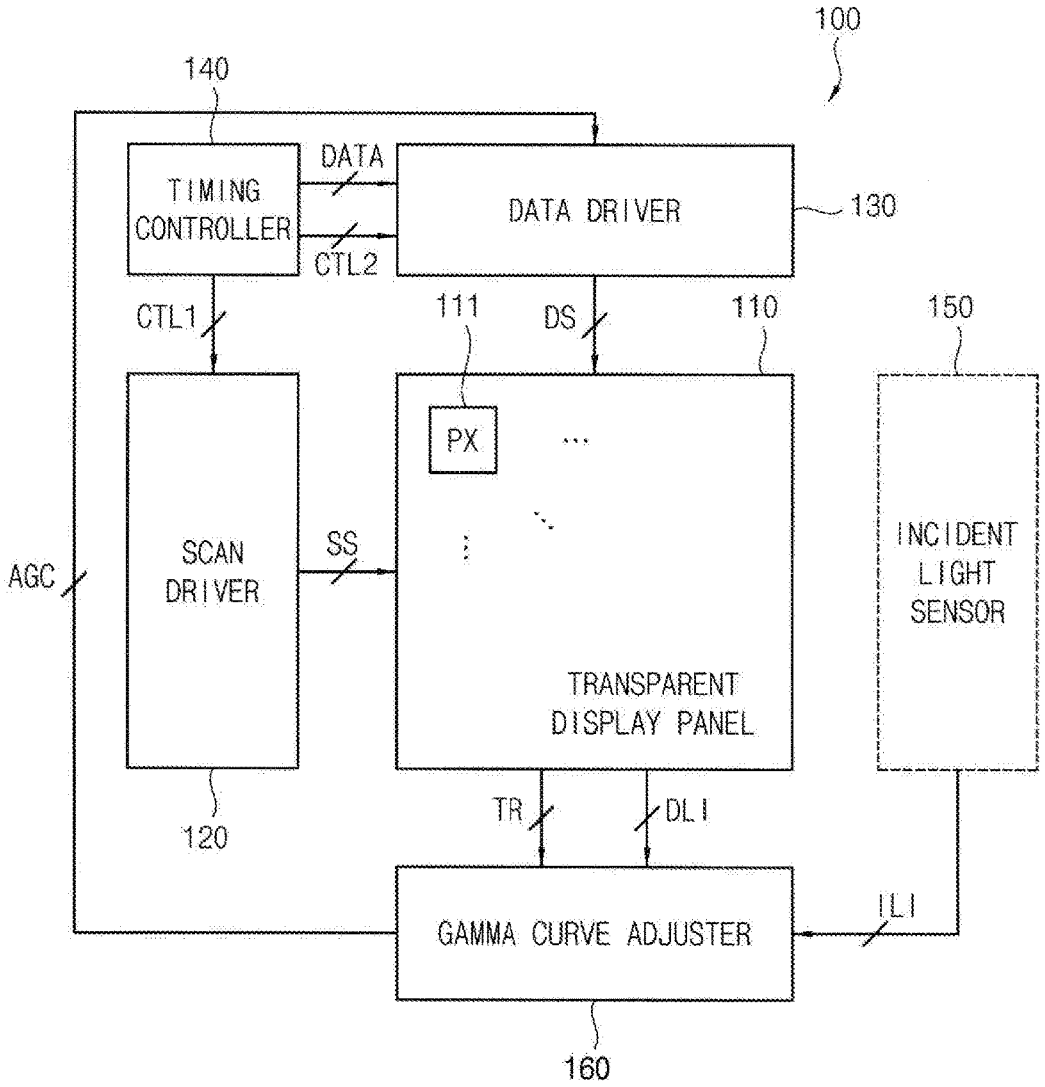
FIG. 1 is a block diagram illustrating exemplary embodiments of a transparent display device according to the invention.

Hereinafter, the invention will be explained in detail with reference to the accompanying drawings. The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this invention will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Figure 2:
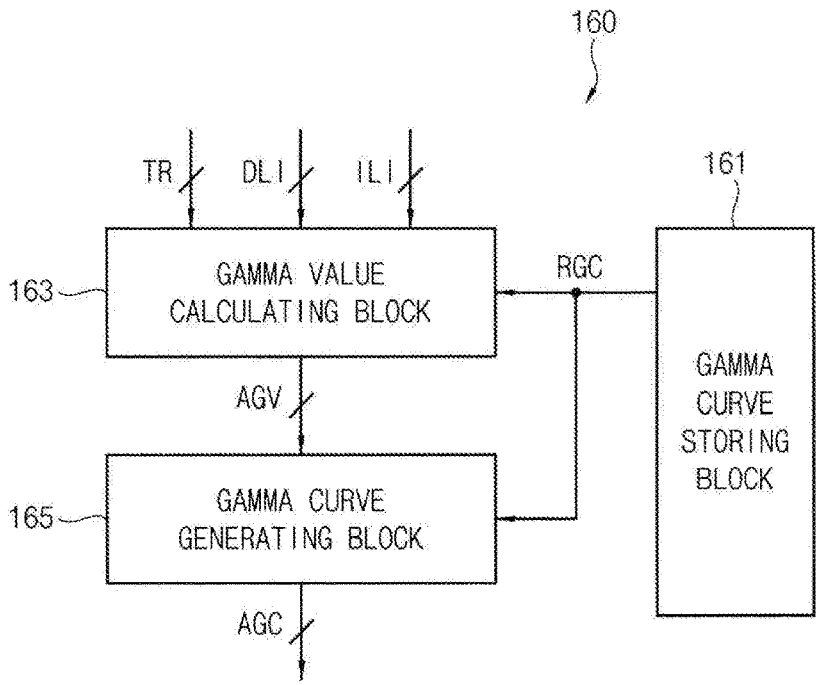
FIG. 2 is a block diagram illustrating a gamma curve adjuster included in the transparent display device of FIG. 1.
Figure 3:
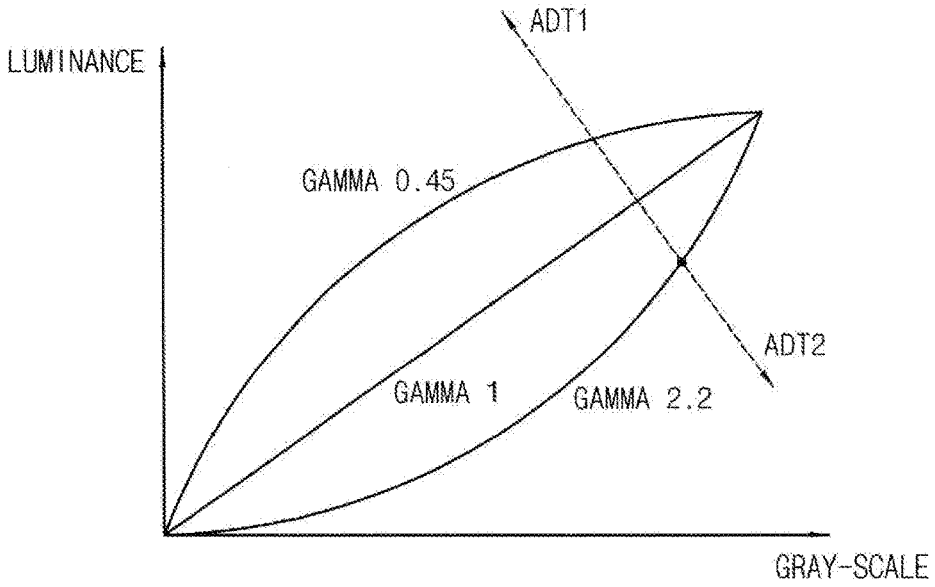
FIG. 3 is a diagram for describing an applied gamma curve that is adjusted by the gamma curve adjuster of FIG. 2.

FIG. 1 is a block diagram illustrating a transparent display device according to exemplary embodiments. FIG. 2 is a block diagram illustrating a gamma curve adjuster included in the transparent display device of FIG. 1. FIG. 3 is a diagram for describing an applied gamma curve that is adjusted by the gamma curve adjuster of FIG. 2.

Referring to FIGS. 1 through 3, the transparent display device 100 may include a transparent display panel 110, a scan driver 120, a data driver 130, a timing controller 140, and a gamma curve adjuster 160. In exemplary embodiments, the transparent display device 100 may further include an incident light sensor 150. In an exemplary embodiment, the transparent display device 100 may be an organic light emitting display ("OLED") device or a liquid crystal display ("LCD") device, for example. However, the transparent display device 100 is not limited thereto.

The transparent display panel 110 may include a plurality of pixels 111. The transparent display panel 110 may display an image including a text, a figure, and the like. Here, since the transparent display panel 110 is transparent, a viewer may recognize an object located behind the transparent display panel 110 as well as visual information displayed on the transparent display panel 110. The transparent display panel 110 may be coupled to the scan driver 120 through scan-lines. The transparent display panel 110 may be coupled to the data driver 120 through data-lines. The scan driver 120 may provide a scan signal SS to the transparent display panel 110 through the scan-lines. The data driver 130 may convert image data DATA into a data signal DS based on an applied gamma curve AGC, and may provide the data signal DS to the transparent display panel 110 through the data-lines. The timing controller 140 may generate control signals CTL1 and CTL2 to control the scan driver 120 and the data driver 130, respectively. The timing controller 140 may receive the image data DATA from an external component and may perform a specific processing (e.g., degradation compensation, etc.) on the image data DATA to provide the image data DATA to the data driver 130. Generally, since external or incident light directly affects an image displayed on the transparent display panel 110, image tone change, image preference degradation, and the like due to the external light may occur. Thus, under a condition in which the external light is relatively strong, a viewer may not clearly recognize an image displayed on the transparent display panel 110. To overcome such a problem, the gamma curve adjuster 160 may adjust the applied gamma curve AGC based on a reference gamma value RGV of a reference gamma curve RGC, luminance of incident light that enters the transparent display panel 110, light transmittance T of the transparent display panel 110, and panel-luminance of the transparent display panel 110. That is, the transparent display device 100 may use or allow for the luminance of the incident light that enters the transparent display panel 110 and the light transmittance T of the transparent display panel 110.

To this end, the gamma curve adjuster 160 may store the reference gamma value RGV of the reference gamma curve RGC and may receive luminance information ILI indicating the luminance of the incident light that enters the transparent display panel 110, light transmittance information TR indicating the light transmittance T of the transparent display panel 110, and panel-luminance information DLI indicating the panel-luminance of the transparent display panel 110. In an exemplary embodiment, as illustrated in FIG. 1, the transparent display device 100 may further include the incident light sensor 150 that measures the luminance of the incident light that enters the transparent display panel 110 and provides the luminance information ILI indicating the luminance of the incident light that enters the transparent display panel 110 to the gamma curve adjuster 160. In other words, the transparent display device 100 may include an internal luminance sensor for measuring the luminance of the incident light that enters the transparent display panel 110. In another exemplary embodiment, the gamma curve adjuster 160 may receive the luminance information ILI indicating the luminance of the incident light that enters the transparent display panel 110 from a light sensing device located outside the transparent display device 100. In other words, the transparent display device 100 may not include an internal luminance sensor for measuring the luminance of the incident light that enters the transparent display panel 110. In an exemplary embodiment, as illustrated in FIG. 1, the gamma curve adjuster 160 may receive the light transmittance information TR indicating the light transmittance T of the transparent display panel 110 from the transparent display panel 110. In another exemplary embodiment, the gamma curve adjuster 160 may receive the light transmittance information TR indicating the light transmittance T of the transparent display panel 110 from other components (e.g., a memory device, etc.) that store the light transmittance information TR. In an exemplary embodiment, as illustrated in FIG. 1, the gamma curve adjuster 160 may receive the panel-luminance information DLI indicating the panel-luminance of the transparent display panel 110 from the transparent display panel 110. In another exemplary embodiment, the gamma curve adjuster 160 may receive the panel-luminance information DLI indicating the panel-luminance of the transparent display panel 110 from other components (e.g., a panel-luminance sensing device, etc.) that store the panel-luminance information DLI.

As illustrated in FIGS. 1 and 2, the gamma curve adjuster 160 may include a gamma curve storing block 161, a gamma value calculating block 163, and a gamma curve generating block 165. The gamma curve storing block 161 may store the reference gamma curve RGC and may provide the reference gamma curve RGC to the gamma value calculating block 163 and/or the gamma curve generating block 165. The gamma value calculating block 163 may receive the reference gamma curve RGC, the luminance information ILI indicating the luminance of the incident light that enters the transparent display panel 110, the light transmittance information TR indicating the light transmittance T of the transparent display panel 110, and the panel-luminance information DLI indicating the panel-luminance of the transparent display panel 110 and may calculate an applied gamma value AGV based on the reference gamma value RGV of the reference gamma curve RGC, the luminance of the incident light that enters the transparent display panel 110, the light transmittance T of the transparent display panel 110, and the panel-luminance of the transparent display panel 110. The gamma curve generating block 165 may receive the applied gamma value AGV from the gamma value calculating block 163 and may generate the applied gamma curve AGC having the applied gamma value AGV. In exemplary embodiments, the gamma curve adjuster 160 may be implemented by a simple calculating circuit or by a look-up table ("LUT"). In an exemplary embodiment, the reference gamma value RGV of the reference gamma curve RGC may be 2.2 by taking into account a darkroom-environment, for example. In an exemplary embodiment, as illustrated in FIG. 3, a 2.2 gamma curve GAMMA 2.2 may be set as the reference gamma curve RGC, for example. When the gamma value calculating block 163 calculates the applied gamma value AGV of the applied gamma curve AGC, the gamma value calculating block 163 may generate a luminance ratio SR by dividing the luminance of the incident light that enters the transparent display panel 110 by the panel-luminance of the transparent display panel 110 and may generate a comparison target value T×SR by multiplying the light transmittance T of the transparent display panel 110 by the luminance ratio SR. Here, when the comparison target value T×SR is smaller than a gamma adjustment reference value, the gamma value calculating block 163 may determine the reference gamma curve RGC to be the applied gamma curve AGC. That is, the reference gamma value RGV of the reference gamma curve RGC may be determined to be the applied gamma value AGV of the applied gamma curve AGC. When the comparison target value T×SR is greater than or equal to the gamma adjustment reference value, the gamma value calculating block 163 may logarithmically decrease the applied gamma value AGV of the applied gamma curve AGC (i.e., indicated by ADT1 in FIG. 3) as the comparison target value T×SR increases, and may logarithmically increase the applied gamma value AGV of the applied gamma curve AGC (i.e., indicated by ADT2 in FIG. 3) as the comparison target value T×SR decreases. In an exemplary embodiment, the gamma adjustment reference value may be 0.1 of which the effectiveness is experimentally established, for example. However, the gamma adjustment reference value is not limited thereto.

Specifically, when the comparison target value T×SR is smaller than the gamma adjustment reference value, the gamma value calculating block 163 may calculate the applied gamma value AGV of the applied gamma curve AGC based on [Equation 1] below.

$$AGV=RGV \quad \text{[Equation 1]}$$

In [Equation 1], AGV denotes the applied gamma value, and RGV denotes the reference gamma value.

In addition, when the comparison target value T×SR is greater than or equal to the gamma adjustment reference value, the gamma value calculating block 163 may calculate the applied gamma value AGV of the applied gamma curve AGC based on [Equation 2] below.

$$AGV=M\times(RGV-K)-N\times\ln(T\times SR) \quad \text{[Equation 2]}$$

In [Equation 2], AGV denotes the applied gamma value, RGV denotes the reference gamma value, T denotes the light transmittance of the transparent display panel, SR denotes the luminance ratio, and M, N, and K are rational numbers other than 0.

In an exemplary embodiment, M may be set to be 1, K may be set to be 0.65, and N may be set to be 0.124 in [Equation 3] below of which the effectiveness is experimentally established, for example. However, the invention is not limited thereto. In an exemplary embodiment, M, N, and K in [Equation 2] may be set in various ways according to requirements for the transparent display device 100.

$$AGV-(RGV-0.66)-0.124\times\ln(T\times SR) \quad \text{[Equation 3]}$$

In [Equation 3], AGV denotes the applied gamma value, RGV denotes the reference gamma value, T denotes the light transmittance of the transparent display panel, and SR denotes the luminance ratio.

In brief, the transparent display device 100 may effectively reduce image tone change, image preference degradation, and the like due to external light that may occur in the image displayed on the transparent display panel 110 included in the transparent display device 100 by adjusting the applied gamma curve AGC based on the reference gamma value RGV of the reference gamma curve RGC, the luminance of the incident light that enters the transparent display panel 110, the light transmittance T of the transparent display panel 110, and the panel-luminance of the transparent display panel 110. As a result, the transparent display device 100 may display a high-quality image in various external light environments. Although it is described above that the transparent display device 100 adjusts a gamma curve, it should be understood that the gamma curve includes a tone curve.

Figure 4:
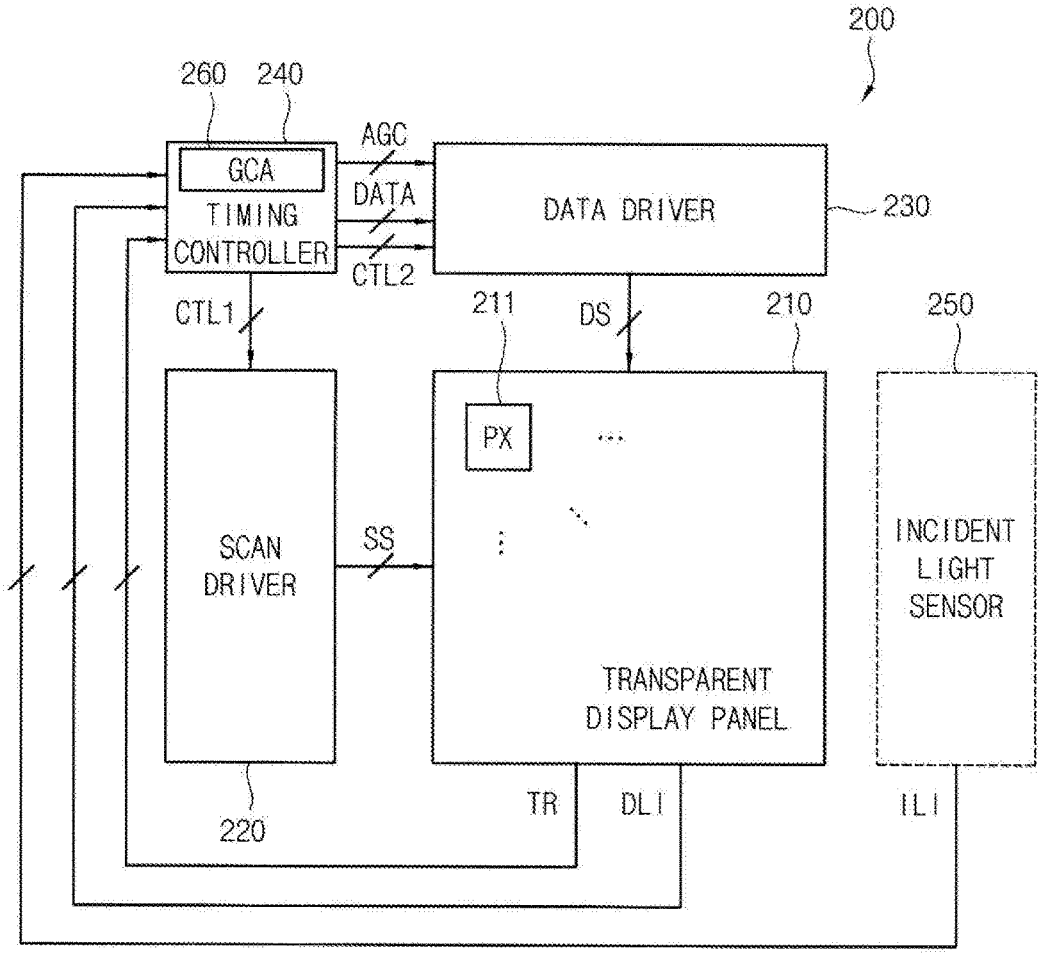
FIG. 4 is a block diagram illustrating exemplary embodiments of a transparent display device according to the invention.

FIG. 4 is a block diagram illustrating a transparent display device according to exemplary embodiments.

Referring to FIG. 4, the transparent display device 200 may include a transparent display panel 210, a scan driver 220, a data driver 230, and a timing controller 240. Here, as illustrated in FIG. 4, the timing controller 240 may include a gamma curve adjuster GCA 260. That is, unlike the transparent display device 100 of FIG. 1, the gamma curve adjuster GCA 260 may be implemented in the timing controller 240 in the transparent display device 200 of FIG. 4. In exemplary embodiments, the transparent display device 200 may further include an incident light sensor 250. In an exemplary embodiment, the transparent display device 200 may be an OLED device or an LCD device, for example. However, the transparent display device 200 is not limited thereto, and may include various other display devices. As described above, the transparent display panel 210 may include a plurality of pixels 211. The transparent display panel 210 may display an image including a text, a figure, and the like. The scan driver 220 may provide a scan signal SS to the transparent display panel 210 through scan-lines. The data driver 230 may convert image data DATA into a data signal DS based on an applied gamma curve AGC and may provide the data signal DS to the transparent display panel 210 through data-lines. The timing controller 240 may generate control signals CTL1 and CTL2 to control the scan driver 220 and the data driver 230, respectively. The gamma curve adjuster GCA 260 included in the timing controller 240 may adjust the applied gamma curve AGC based on a reference gamma value of a reference gamma curve, luminance of incident light that enters the transparent display panel 210, light transmittance of the transparent display panel 210, and panel-luminance of the transparent display panel 210. Thus, the transparent display device 200 may effectively reduce image tone change, image preference degradation, and the like due to external light that may occur in an image displayed on the transparent display panel 210 included in the transparent display device 200, so that the transparent display device 200 may display a high-quality image in various external light environments. Since these are described above, duplicated description will not be repeated.

Figure 5:
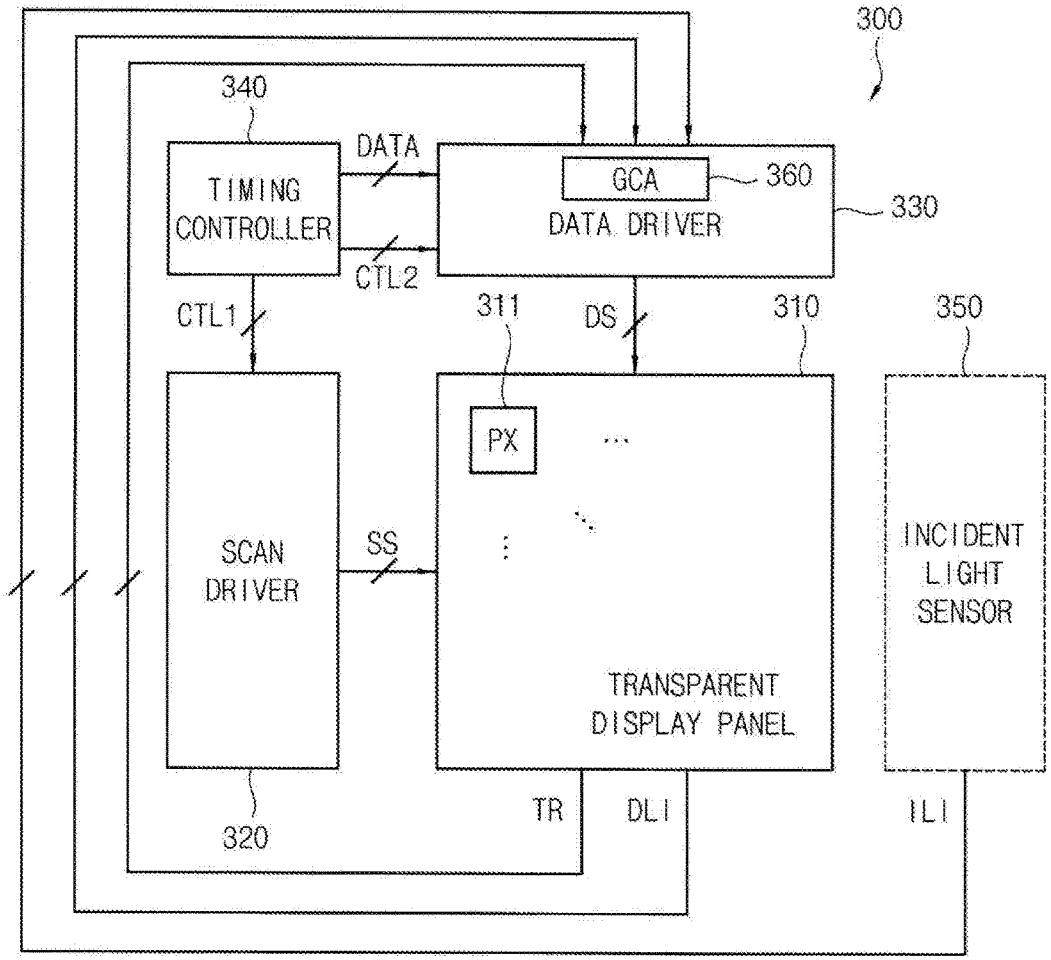
FIG. 5 is a block diagram illustrating exemplary embodiments of a transparent display device according to the invention.

FIG. 5 is a block diagram illustrating a transparent display device according to exemplary embodiments.

Referring to FIG. 5, the transparent display device 300 may include a transparent display panel 310, a scan driver 320, a data driver 330, and a timing controller 340. Here, as illustrated in FIG. 5, the data driver 330 may include a gamma curve adjuster 360. That is, unlike the transparent display device 100 of FIG. 1, the gamma curve adjuster GCA 360 may be included (e.g., implemented) in the data driver 330 in the transparent display device 300 of FIG. 5. In exemplary embodiments, the transparent display device 300 may further include an incident light sensor 350. In an exemplary embodiment, the transparent display device 300 may be an OLED device or an LCD device, for example. However, the transparent display device 300 is not limited thereto, and may include various other display devices. As described above, the transparent display panel 310 may include a plurality of pixels 311. The transparent display panel 310 may display an image including a text, a figure, and the like. The scan driver 320 may provide a scan signal SS to the transparent display panel 310 through scan-lines. The data driver 330 may convert image data DATA into a data signal DS based on an applied gamma curve and may provide the data signal DS to the transparent display panel 310 through data-lines. The gamma curve adjuster GCA 360 included in the data driver 330 may adjust the applied gamma curve based on a reference gamma value of a reference gamma curve, luminance of incident light that enters the transparent display panel 310, light transmittance of the transparent display panel 310, and panel-luminance of the transparent display panel 310. The timing controller 340 may generate control signals CTL1 and CTL2 to control the scan driver 320 and the data driver 330, respectively. Thus, the transparent display device 300 may effectively reduce image tone change, image preference degradation, and the like due to external light that may occur in an image displayed on the transparent display panel 310 included in the transparent display device 300, so that the transparent display device 300 may display a high-quality image in various external light environments. Since these are described above, duplicated description will not be repeated.

Figure 6:
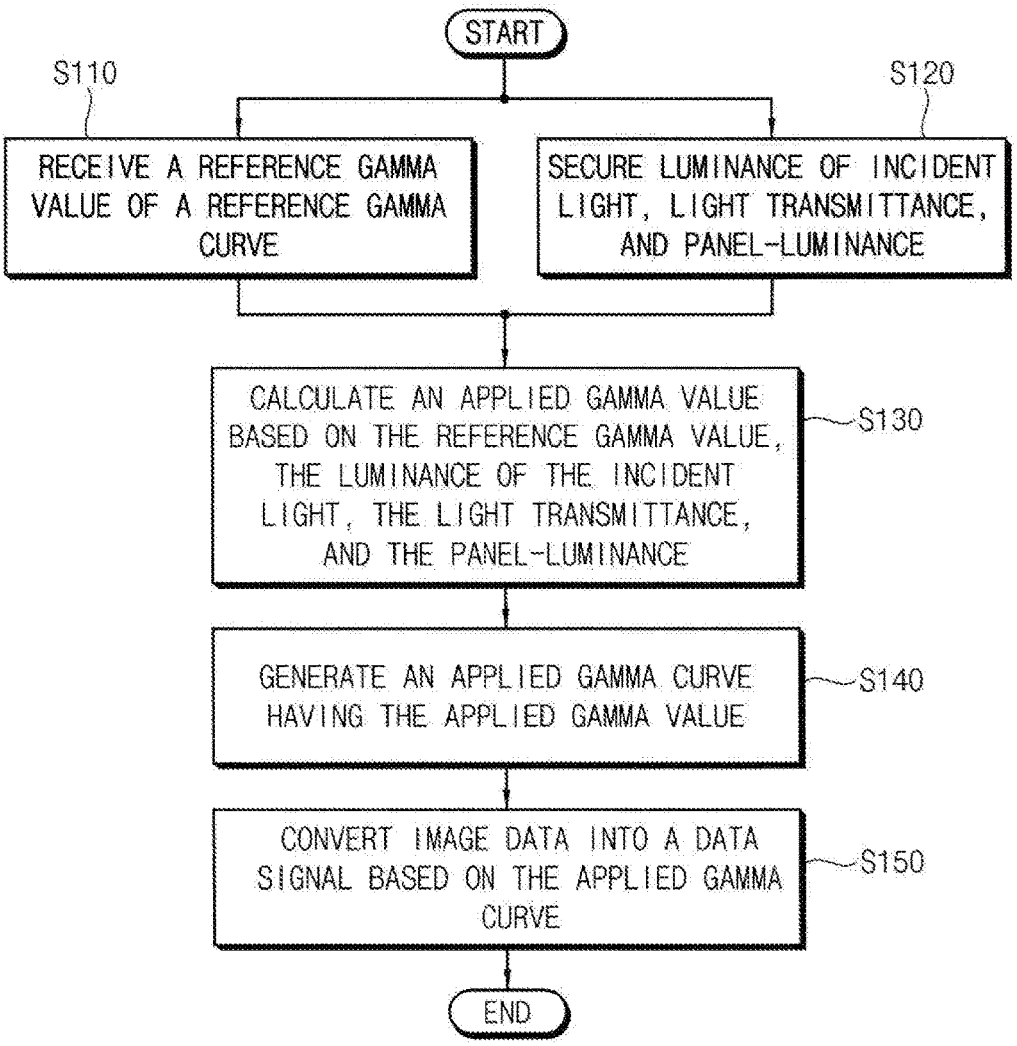
FIG. 6 is a flowchart illustrating exemplary embodiments of a method of compensating an image for a transparent display device according to the invention.
Figure 7:
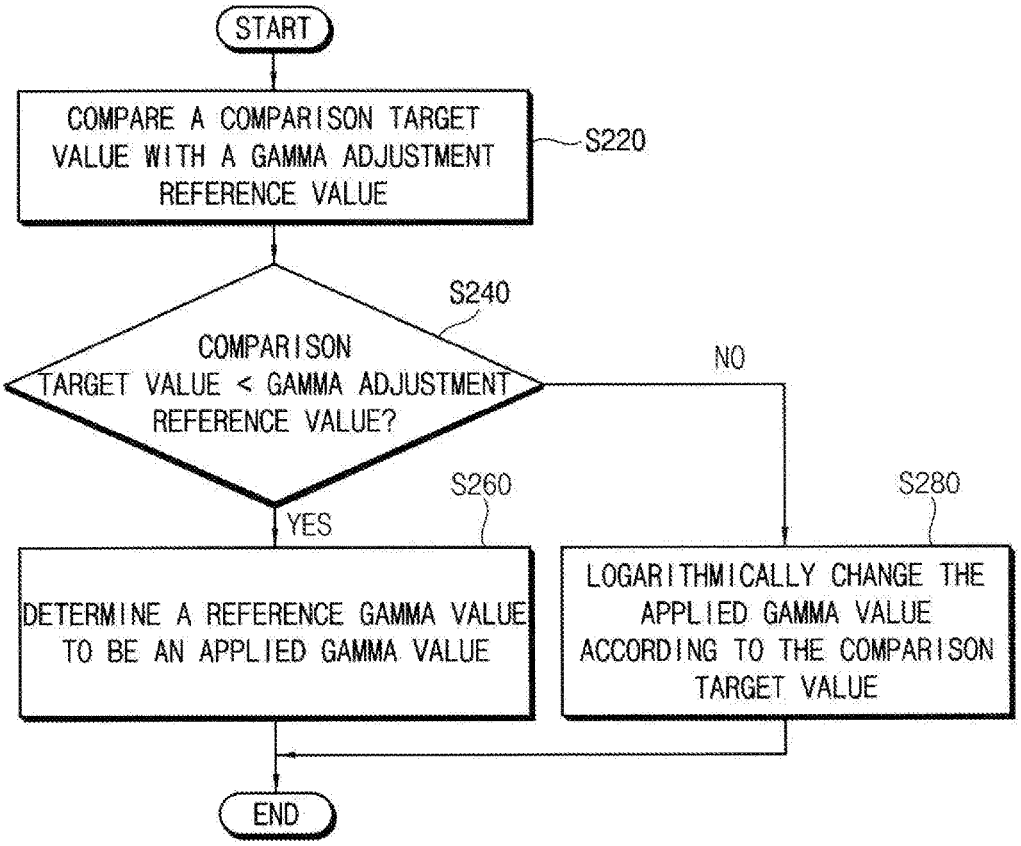
FIG. 7 is a flowchart illustrating a process in which an applied gamma curve is adjusted by the method of FIG. 6.
Figure 8:
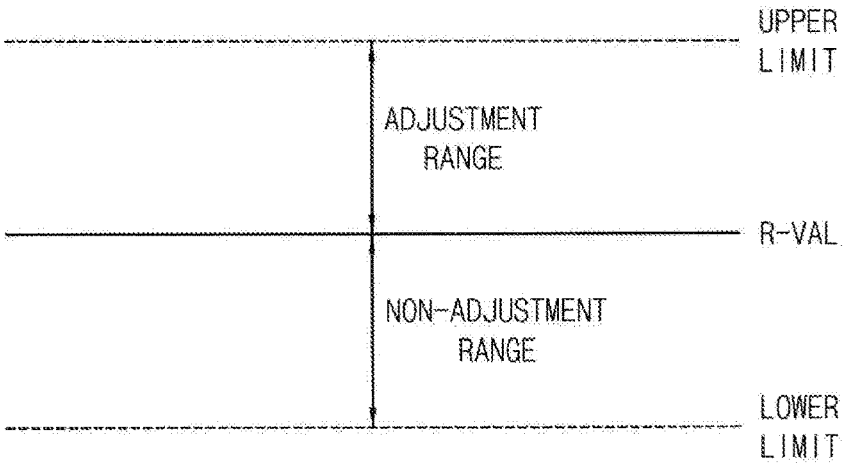
FIG. 8 is a diagram for describing a process in which an applied gamma curve is adjusted by the method of FIG. 6.

FIG. 6 is a flowchart illustrating a method of compensating an image for a transparent display device according to exemplary embodiments. FIG. 7 is a flowchart illustrating a process in which an applied gamma curve is adjusted by the method of FIG. 6. FIG. 8 is a diagram for describing a process in which an applied gamma curve is adjusted by the method of FIG. 6.

Referring to FIGS. 6 through 8, the method of FIG. 6 may receive a reference gamma value of a reference gamma curve (S110), may secure or obtain luminance of incident light that enters a transparent display panel, light transmittance of the transparent display panel, and panel-luminance of the transparent display panel (S120), and then may calculate an applied gamma value based on the reference gamma value of the reference gamma curve, the luminance of the incident light, the light transmittance of the transparent display panel, and the panel-luminance of the transparent display panel (S130). Next, the method of FIG. 6 may generate an applied gamma curve having the applied gamma value (S140) and may convert image data into a data signal to be applied to the transparent display panel based on the applied gamma curve (S150).

To calculate the applied gamma value of the applied gamma curve, the method of FIG. 6 may generate a luminance ratio by dividing the luminance of the incident light that enters the transparent display panel by the panel-luminance of the transparent display panel and may generate a comparison target value by multiplying the light transmittance of the transparent display panel by the luminance ratio. FIG. 7 shows a process in which the applied gamma curve is adjusted by the method of FIG. 6. Specifically, referring to FIGS. 6 to 8, the method of FIG. 6 may compare the comparison target value with a gamma adjustment reference value R-VAL (S220) and check whether the comparison target value is smaller than the gamma adjustment reference value R-VAL (S240). In an exemplary embodiment, the gamma adjustment reference value R-VAL may be 0.1 of which the effectiveness is experimentally established, for example. However, the gamma adjustment reference value R-VAL is not limited thereto. Here, when the comparison target value is smaller than the gamma adjustment reference value R-VAL, as shown in [Equation 1] above, the method of FIG. 6 may determine the reference gamma value of the reference gamma curve to be the applied gamma value of the applied gamma curve (S260). That is, the reference gamma curve may be determined to be the applied gamma curve (i.e., indicated by NON-ADJUSTMENT RANGE in FIG. 8). When the comparison target value is not smaller than the gamma adjustment reference value R-VAL (i.e., when the comparison target value is greater than or equal to the gamma adjustment reference value R-VAL), as shown in [Equation 2] above, the method of FIG. 6 may logarithmically change the applied gamma value of the applied gamma curve according to the comparison target value (S280). Specifically, the method of FIG. 6 may logarithmically decrease the applied gamma value of the applied gamma curve as the comparison target value increases and may logarithmically increase the applied gamma value of the applied gamma curve as the comparison target value decreases. In other words, the applied gamma curve may be adjusted (or, changed) with respect to the reference gamma curve (i.e., indicated by ADJUSTMENT RANGE in FIG. 8). As described above, the method of FIG. 6 may effectively reduce image tone change, image preference degradation, and the like due to external light that may occur in an image displayed on the transparent display panel by adjusting the applied gamma curve based on the reference gamma value of the reference gamma curve, the luminance of the incident light that enters the transparent display panel, the light transmittance of the transparent display panel, and the panel-luminance of the transparent display panel.

Figure 9:
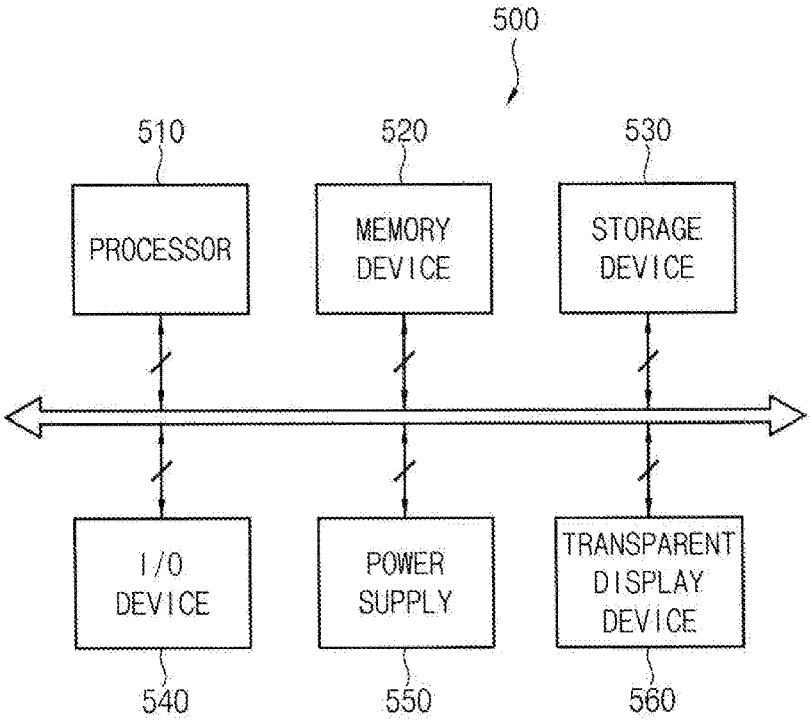
FIG. 9 is a block diagram illustrating exemplary embodiments of an electronic device according to the invention.
Figure 10A:
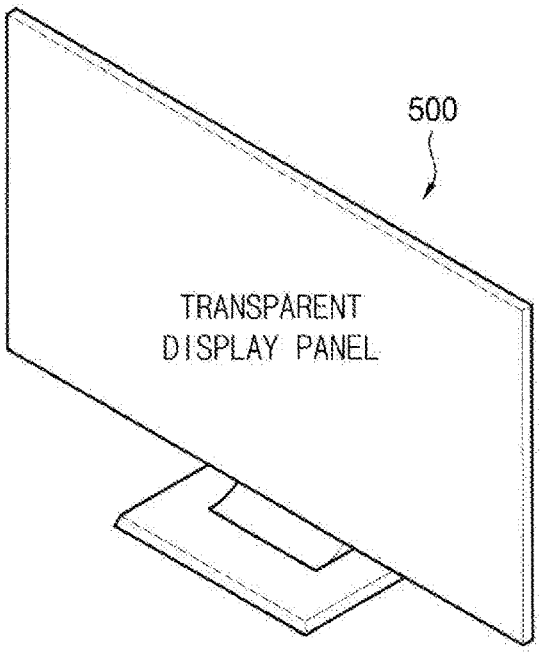
FIG. 10A is a diagram illustrating an exemplary embodiment in which the electronic device of FIG. 9 is implemented as a transparent television.
Figure 10B:
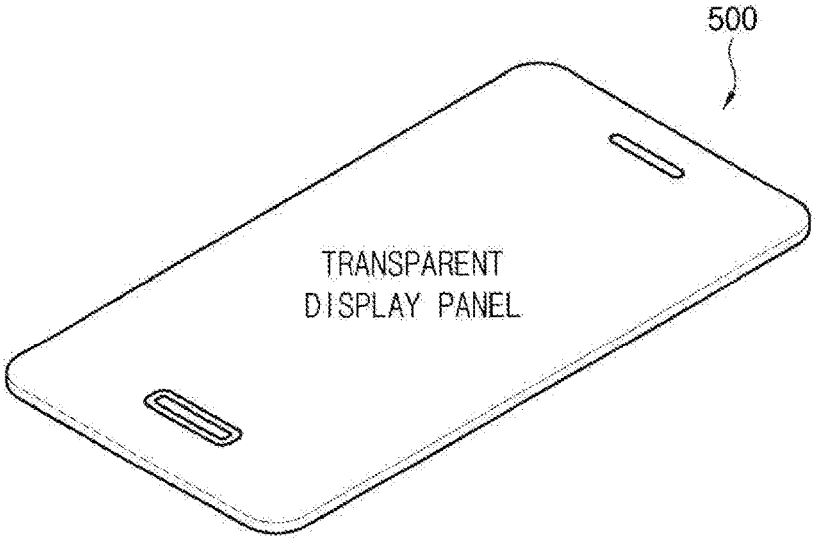
FIG. 10B is a diagram illustrating an exemplary embodiment in which the electronic device of FIG. 9 is implemented as a transparent smart phone.

FIG. 9 is a block diagram illustrating an electronic device according to exemplary embodiments. FIG. 10A is a diagram illustrating an example in which the electronic device of FIG. 9 is implemented as a transparent television. FIG. 10B is a diagram illustrating an example in which the electronic device of FIG. 9 is implemented as a transparent smart phone.

Referring to FIGS. 9 through 10B, the electronic device 500 may include a processor 510, a memory device 520, a storage device 530, an input/output ("I/O") device 540, a power supply 550, and a transparent display device 560. Here, the transparent display device 560 may correspond to the transparent display device 100 of FIG. 1, the transparent display device 200 of FIG. 4, or the transparent display device 300 of FIG. 5. In addition, the electronic device 500 may further include a plurality of ports for communicating with a video card, a sound card, a memory card, a universal serial bus ("USB") device, other electronic devices, etc. In an exemplary embodiment, as illustrated in FIG. 10A, the electronic device 500 may be implemented as a transparent television, for example. In another exemplary embodiment, as illustrated in FIG. 10B, the electronic device 500 may be implemented as a transparent smart phone, for example. However, the electronic device 500 is not limited thereto. In an exemplary embodiment, the electronic device 500 may be implemented as a cellular phone, a video phone, a smart pad, a smart watch, a tablet personal computer ("PC"), a car navigation system, a computer monitor, a laptop, a head mounted display ("HMD"), etc., for example.

The processor 510 may perform various computing functions. In an exemplary embodiment, the processor 510 may be a micro processor, a central processing unit ("CPU"), an application processor ("AP"), etc., for example. In an exemplary embodiment, the processor 510 may be coupled to other components via an address bus, a control bus, a data bus, etc., for example. In an exemplary embodiment, the processor 510 may be coupled to an extended bus such as a peripheral component interconnection ("PCI") bus., for example. The memory device 520 may store data for operations of the electronic device 500. In an exemplary embodiment, the memory device 520 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc., and/or at least one volatile memory device such as a dynamic random access memory ("DRAM") device, a static random access memory ("SRAM") device, a mobile DRAM device, etc., for example. In an exemplary embodiment, the storage device 530 may include a solid state drive ("SSD") device, a hard disk drive ("HDD") device, a compact disk read-only memory ("CD-ROM") device, etc., for example. In an exemplary embodiment, the I/O device 540 may include an input device such as a keyboard, a keypad, a mouse device, a touchpad, a touch-screen, etc., and an output device such as a printer, a speaker, etc. The power supply 550 may provide power for operations of the electronic device 500. In exemplary embodiments, the transparent display device 560 may be included in the I/O device 540.

The display device 560 may be coupled to other components via the buses or other communication links. As described above, the transparent display device 560 may effectively reduce image tone change, image preference degradation, and the like due to external light that may occur in an image displayed on a transparent display panel included in the transparent display device 560 by adjusting an applied gamma curve based on a reference gamma value of a reference gamma curve, luminance of incident light that enters the transparent display panel, light transmittance of the transparent display panel, and panel-luminance of the transparent display panel. As a result, the transparent display device 560 may display a high-quality image in various external light environments. For this operation, the transparent display device 560 may include the transparent display panel, a scan driver, a data driver, a timing controller, and a gamma curve adjuster. The transparent display panel may display an image. The scan driver may provide a scan signal to the transparent display panel. The data driver may convert image data into a data signal based on the applied gamma curve and may provide the data signal to the transparent display panel. The timing controller may control the scan driver and the data driver. The gamma curve adjuster may adjust the applied gamma curve based on the reference gamma value of the reference gamma curve, the luminance of the incident light that enters the transparent display panel, the light transmittance of the transparent display panel, and the panel-luminance of the transparent display panel. Here, the gamma curve adjuster may include a gamma curve storing block that stores the reference gamma curve, a gamma value calculating block that calculates an applied gamma value based on the reference gamma value of the reference gamma curve, the luminance of the incident light, the light transmittance of the transparent display panel, and the panel-luminance of the transparent display panel, and a gamma curve generating block that generates the applied gamma curve having the applied gamma value. Since structures and operations of the transparent display panel 560 are described above, duplicated description will not be repeated.

The invention may be applied to a transparent display device and an electronic device including the transparent display device. In an exemplary embodiment, the invention may be applied to a cellular phone, a smart phone, a video phone, a smart pad, a smart watch, a tablet PC, a car navigation system, a television, a computer monitor, a laptop, a head mounted display, etc., for example.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A transparent display device comprising:

a transparent display panel which displays an image;

a scan driver which provides a scan signal to the transparent display panel;

a data driver which converts image data into a data signal based on an applied gamma curve and provides the data signal to the transparent display panel;

a timing controller which controls the scan driver and the data driver; and a gamma curve adjuster which adjusts the applied gamma curve based on a reference gamma value of a reference gamma curve, luminance of incident light which enters the transparent display panel, light transmittance of the transparent display panel, and panel-luminance of the transparent display panel, wherein the gamma curve adjuster includes:

a gamma curve storing block which stores the reference gamma curve;

a gamma value calculating block which calculates an applied gamma value based on the reference gamma value of the reference gamma curve, the luminance of the incident light, the light transmittance of the transparent display panel, and the panel-luminance of the transparent display panel; and a gamma curve generating block which generates the applied gamma curve having the applied gamma value.

2. The transparent display device of claim 1, further comprising:

an incident light sensor which measures the luminance of the incident light and provides luminance information which indicates the luminance of the incident light to the gamma curve adjuster.

3. The transparent display device of claim 1, wherein the gamma curve adjuster receives luminance information which indicates the luminance of the incident light from a light sensing device located outside the transparent display device.

4. The transparent display device of claim 1, wherein the gamma curve adjuster receives light transmittance information which indicates the light transmittance of the transparent display panel from the transparent display panel.

5. The transparent display device of claim 1, wherein the gamma curve adjuster receives panel-luminance information which indicates the panel-luminance of the transparent display panel from the transparent display panel.

6. The transparent display device of claim 1, wherein the reference gamma value of the reference gamma curve is 2.2.

7. The transparent display device of claim 1, wherein the gamma value calculating block generates a luminance ratio by dividing the luminance of the incident light by the panel-luminance of the transparent display panel and generates a comparison target value by multiplying the light transmittance of the transparent display panel by the luminance ratio.

8. The transparent display device of claim 7, wherein the gamma value calculating block determines the reference gamma curve to be the applied gamma curve when the comparison target value is smaller than a gamma adjustment reference value.

9. The transparent display device of claim 8, wherein when the comparison target value is smaller than the gamma adjustment reference value, the gamma value calculating block calculates the applied gamma value based on [Equation 1] below:

$$AGV=RGV, \text{[Equation 1]}$$

where AGV denotes the applied gamma value, and RGV denotes the reference gamma value.

10. The transparent display device of claim 7, wherein the gamma value calculating block logarithmically decreases the applied gamma value as the comparison target value increases when the comparison target value is greater than or equal to a gamma adjustment reference value.

11. The transparent display device of claim 10, wherein when the comparison target value is greater than or equal to the gamma adjustment reference value, the gamma value calculating block calculates the applied gamma value based on [Equation 2] below:

$$AGV=M\times(RGV-K)-N\times\ln(T\times SR), \text{[Equation 2]}$$

where AGV denotes the applied gamma value, RGV denotes the reference gamma value, T denotes the light transmittance of the transparent display panel, SR denotes the luminance ratio, and M, N, and K are rational numbers other than 0.

12. The transparent display device of claim 1, wherein the gamma curve adjuster is included in one of the timing controller and in the data driver.

13. The transparent display device of claim 1, wherein the gamma curve adjuster is separated from the timing controller and the data driver.

14. A method of compensating an image for a transparent display device, the method comprising:

receiving a reference gamma value of a reference gamma curve;

securing luminance of incident light which enters a transparent display panel included in the transparent display device, light transmittance of the transparent display panel, and panel-luminance of the transparent display panel;

calculating an applied gamma value based on the reference gamma value of the reference gamma curve, the luminance of the incident light, the light transmittance of the transparent display panel, and the panel-luminance of the transparent display panel;

generating an applied gamma curve having the applied gamma value; and converting image data into a data signal to be applied to the transparent display panel based on the applied gamma curve, wherein calculating the applied gamma value includes:

generating a luminance ratio by dividing the luminance of the incident light by the panel-luminance of the transparent display panel; and generating a comparison target value by multiplying the light transmittance of the transparent display panel by the luminance ratio.

15. The method of claim 14, wherein the reference gamma curve is determined to be the applied gamma curve when the comparison target value is smaller than a gamma adjustment reference value.

16. The method of claim 15, wherein when the comparison target value is smaller than the gamma adjustment reference value, the applied gamma value is calculated based on [Equation 1] below:

$$AGV=RGV, \text{[Equation 1]}$$

where AGV denotes the applied gamma value, and RGV denotes the reference gamma value.

17. The method of claim 14, wherein the applied gamma value is logarithmically decreased as the comparison target value increases when the comparison target value is greater than or equal to a gamma adjustment reference value.

18. The method of claim 17, wherein when the comparison target value is greater than or equal to the gamma adjustment reference value, the applied gamma value is calculated based on [Equation 2] below:

$$AGV=M\times(RGV-K)-N\times\ln(T\times SR), \text{[Equation 2]}$$

where AGV denotes the applied gamma value, RGV denotes the reference gamma value, T denotes the light transmittance of the transparent display panel, SR denotes the luminance ratio, and M, N, and K are rational numbers other than 0.

* * * * *